US012084820B2

(12) United States Patent
Groeneweg et al.

(10) Patent No.: US 12,084,820 B2
(45) Date of Patent: Sep. 10, 2024

(54) MOBILE BARRIER WITH A SLIDING REINFORCED WALL

(71) Applicant: Concaten, Inc., Golden, CO (US)

(72) Inventors: Kevin K. Groeneweg, Golden, CO (US); Taylor Groeneweg, Golden, CO (US)

(73) Assignee: Concaten, Inc., Golden, CO (US)

( * ) Notice: Subject to any disclaimer, the term of this patent is extended or adjusted under 35 U.S.C. 154(b) by 653 days.

(21) Appl. No.: 17/381,088

(22) Filed: Jul. 20, 2021

(65) Prior Publication Data

US 2022/0025593 A1 Jan. 27, 2022

Related U.S. Application Data

(60) Provisional application No. 63/055,217, filed on Jul. 22, 2020.

(51) Int. Cl.
*E01F 15/14* (2006.01)
*E01F 13/02* (2006.01)

(52) U.S. Cl.
CPC ..... *E01F 15/148* (2013.01); *E01F 13/02* (2013.01)

(58) Field of Classification Search
CPC ..... E01F 13/02; E01F 15/148
USPC ..... 404/6, 9
See application file for complete search history.

(56) References Cited

U.S. PATENT DOCUMENTS 3,391,620 A * 7/1968 Mahoney ..... E01F 15/006 404/6
4,004,857 A * 1/1977 Eschen, Jr. ..... E01F 15/006 404/9
7,341,397 B2 * 3/2008 Murphy ..... F16F 7/12 404/6
7,354,218 B1 * 4/2008 Dyke ..... E01F 15/006 404/6
7,572,022 B2 8/2009 Groeneweg
7,901,117 B2 3/2011 Groeneweg
8,322,945 B2 12/2012 Groeneweg et al.
8,465,047 B2 6/2013 Groeneweg
8,628,110 B2 1/2014 Groeneweg
8,657,525 B2 2/2014 Groeneweg et al.
8,740,241 B2 6/2014 Groeneweg
8,777,255 B2 7/2014 Groeneweg
8,845,229 B2 9/2014 Groeneweg et al.
9,267,250 B2 2/2016 Groeneweg
9,273,437 B2 3/2016 Groeneweg et al.
9,394,657 B2 7/2016 Groeneweg et al.
(Continued)

OTHER PUBLICATIONS

International Search Report and Written Opinion of the ISA in co-pending case PCT/US21/042618.

*Primary Examiner* — Raymond W Addie
(74) *Attorney, Agent, or Firm* — Carl A. Hjort, III

(57) ABSTRACT

A mobile barrier is shown having first and second platforms, at least one of the first and second platforms engaged with an axle and a set of wheels; a safety wall assembly, having a mechanism for translation of the safety wall from one side of the platforms to another, the safety wall further having telescoping first and second portions allowing the safety wall assembly to expand and retract in length along the longitudinal axis of the mobile barrier; a plurality of variable length braces connected to the platforms and the safety wall, which expand and retract as the safety wall moves from one side of the platforms to the other.

26 Claims, 8 Drawing Sheets

(56) References Cited

U.S. PATENT DOCUMENTS

| | | | |
|---|---|---|---|
| 9,481,969 | B2 | 11/2016 | Groeneweg et al. |
| 9,527,539 | B1 | 12/2016 | Hellbusch |
| 9,725,858 | B2 | 8/2017 | Groeneweg |
| 9,732,482 | B2 | 8/2017 | Groeneweg |
| 10,179,981 | B2 | 1/2019 | Groeneweg et al. |
| 10,240,308 | B2 | 3/2019 | Groeneweg et al. |
| 10,301,787 | B2 | 5/2019 | Groeneweg |
| 10,428,474 | B2 | 10/2019 | Groeneweg |
| D871,268 | S | 12/2019 | Groeneweg |
| 10,669,681 | B2 | 6/2020 | Groeneweg et al. |
| 10,920,384 | B2 | 2/2021 | Groeneweg et al. |
| 11,384,494 | B2 | 7/2022 | Groeneweg |
| 11,512,441 | B2 | 11/2022 | Groeneweg et al. |
| 11,560,679 | B2 | 1/2023 | Groeneweg et al. |
| 11,668,059 | B2 | 6/2023 | Groeneweg |
| 2005/0141960 | A1 | 6/2005 | Schiefferly et al. |
| 2009/0166998 | A1 | 7/2009 | Groeneweg |
| 2014/0239613 | A1 | 8/2014 | Groeneweg |
| 2019/0100890 | A1 | 4/2019 | Groeneweg |
| 2019/0292739 | A1 | 9/2019 | Groeneweg |
| 2023/0092342 | A1 | 2/2023 | Groeneweg et al. |
| 2023/0036319 | A1 | 3/2023 | Groeneweg et al. |
| 2023/0101099 | A1 | 3/2023 | Groeneweg et al. |
| 2023/0160163 | A1 | 5/2023 | Groeneweg et al. |
| 2023/0175216 | A1 | 6/2023 | Groeneweg |

* cited by examiner

MOBILE BARRIER WITH A SLIDING REINFORCED WALL

CROSS-REFERENCE TO RELATED APPLICATIONS

The present application claims the benefits of U.S. Provisional Application Ser. No. 63/055,217, filed Jul. 22, 2020, having the same title, and which is incorporated herein by this reference.

DETAILED DESCRIPTION OF THE DRAWINGS

Figure 1A:
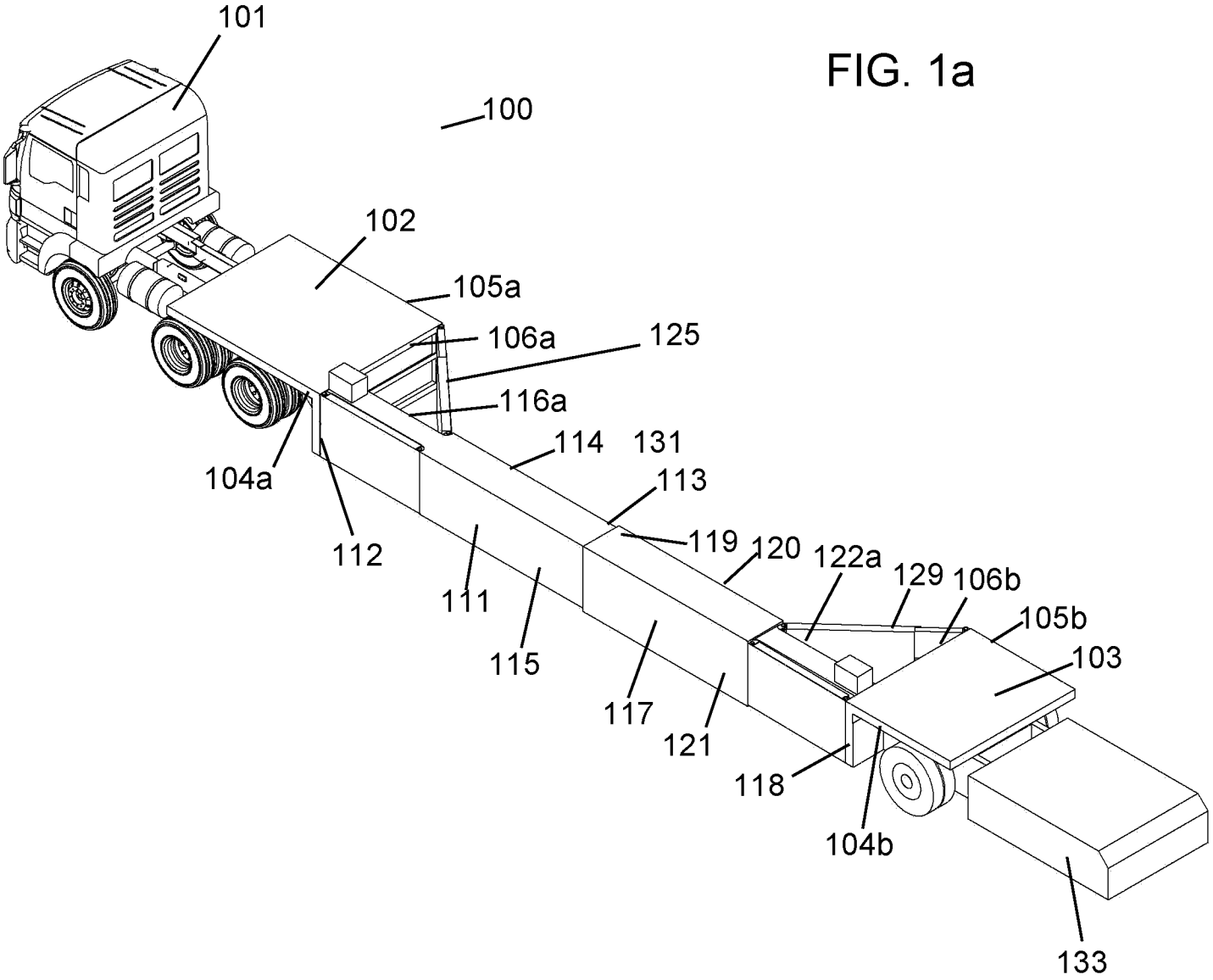
FIGS. 1*a*-1*c* show a first embodiment of the mobile barrier with a sliding reinforced wall.
Figure 1B:
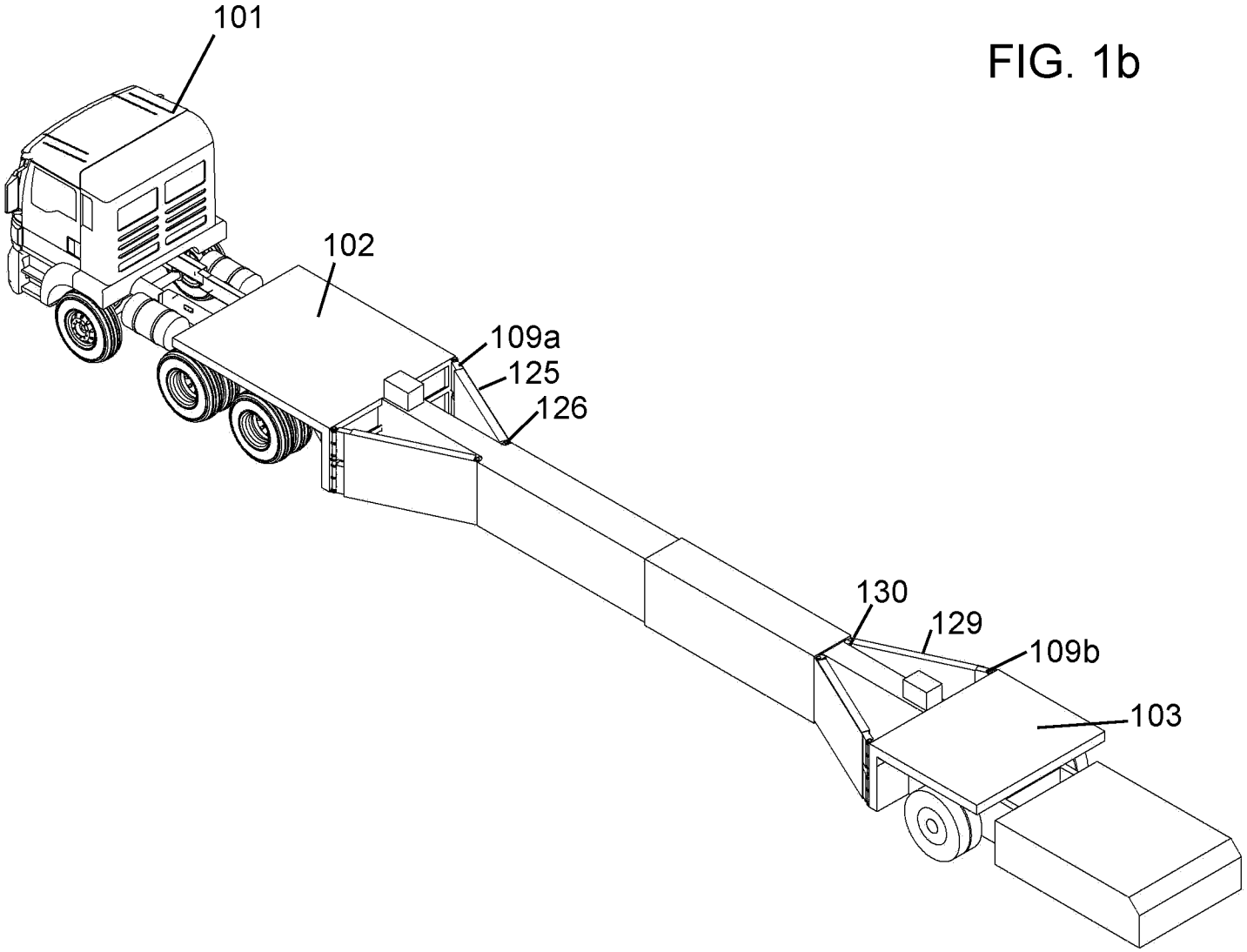
Figure 1C:
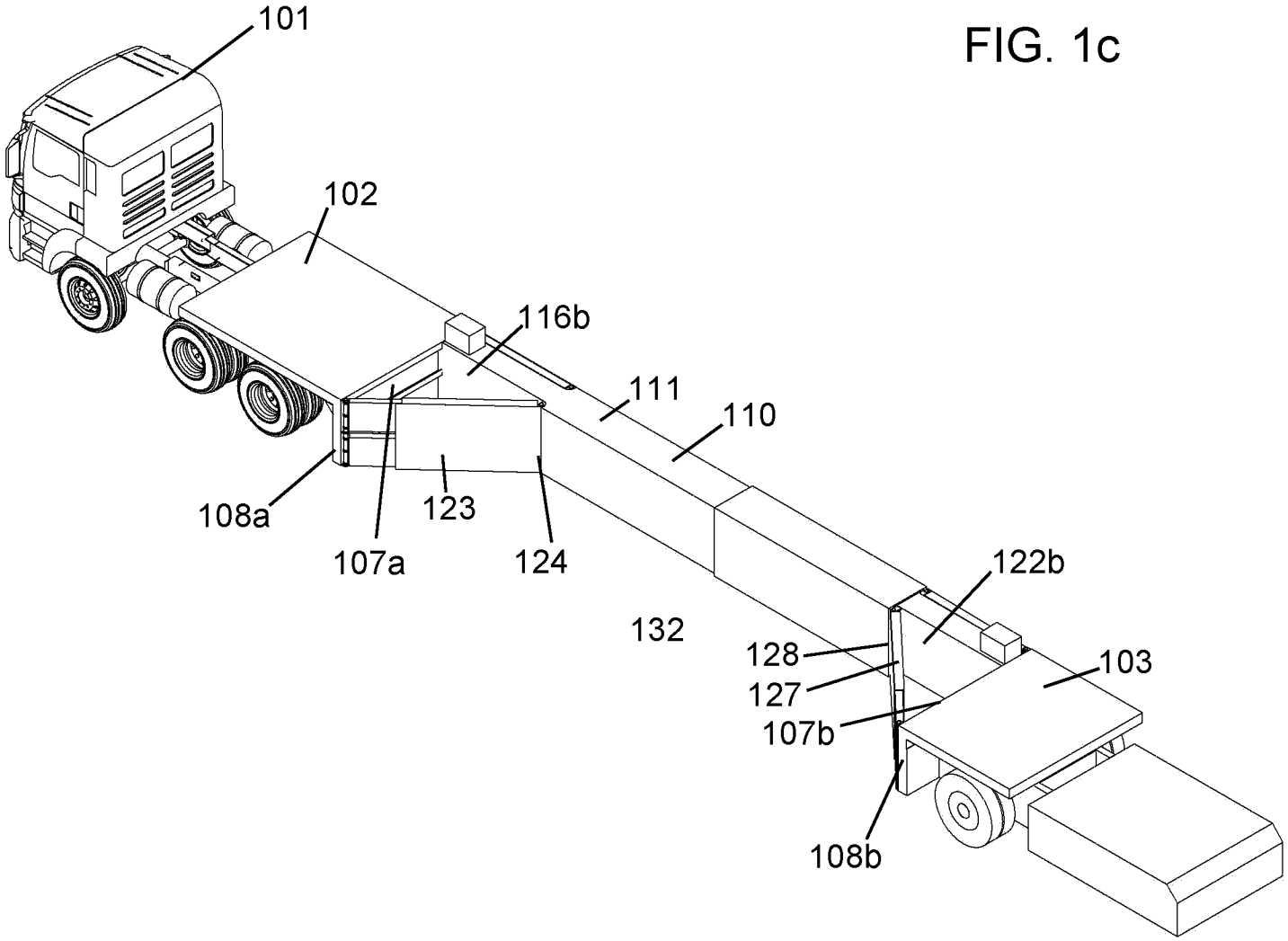

FIGS. 1*a*-1*c* show a first embodiment of the mobile barrier with a sliding reinforced wall. It should be appreciated that certain elements of the device are common to all embodiments, and those common elements will be denoted by like numerals in all figures. Thus, in FIGS. 1*a*-*c*, the mobile barrier 100 may be connected to a tractor 101 for transport to a job site. While in FIGS. 1*a*-*c*, a heavy duty commercial vehicle of FHWA class 8 is shown, it should be appreciated that any vehicle capable of towing the mobile barrier could be used in place of the tractor 101. If a heavy duty commercial vehicle, such as the one shown in FIGS. 1*a*-*c*, is used to tow the mobile barrier 100, the barrier may be provided with a kingpin (not shown) that mates with a fifth wheel (not shown) on the tractor 101 to couple the mobile barrier 100 to the tractor 101 for towing. Alternatively, if the mobile barrier is to be towed by another type of vehicle, e.g. a dump truck, that does not have a fifth wheel capable of engaging a kingpin, an alternative hitch may be provided on the mobile barrier 100 to couple to such a vehicle. It should further be appreciated that the mobile barrier 100 may be provided with more than one type of hitch, so that it could be towed by multiple types of vehicles. By way of example and without limitation, the mobile barrier 100 could be provided with a kingpin to couple to FHWA class 8 tractors as well as another hitch to couple to suitable vehicles that do not use a kingpin for coupling. Any and all hitches that perform the function of coupling the mobile barrier 100 to a vehicle capable of towing it are included within the scope of this disclosure.

Also shown in FIGS. 1*a*-*c*, and common to all embodiments, are the first and second platforms 102 and 103. As shown in FIGS. 1*a*-*c*, the first platform 102 may have a kingpin (not shown) that allows the first platform 102 to couple to a towing vehicle, such as the tractor 101. In this case, the first platform 102 need not be provided with an axle and a set of wheels, because the wheels on the towing vehicle are disposed underneath the first platform 102. As shown in FIGS. 1*a*-*c*, the second platform 103 is provided with an axle and a set of wheels. It should be appreciated that several variations on the construction of the first and second platforms 102 and 103 are within the scope of this disclosure. By way of example and without limitation, both first and second platforms 102 and 103 may each be provided with one or more sets of axles and wheels. Alternatively, neither of the first and second platforms 102 and 103 may be provided with axles and wheels, in which case, the first platform 102 will overlie the wheels on a towing vehicle, and a separate wheeled caboose (not shown) may be provided at the second platform 103 to provide wheels for the second platform 103. A Truck Mounted Attenuator (TMA) 133 may be provided on the second platform 103 to absorb the kinetic energy of a rear-end impact on the mobile barrier.

As can be seen in FIGS. 1*a*-*c*, the first and second platforms 102 and 103 each have a right edge 104*a*, 104*b* and a left edge 105*a*, 105*b*; an interior edge 106*a*, 106*b* perpendicular to the respective right and left edges and an interior surface 107*a*, 107*b* depending downwardly from the interior edge. The interior surfaces 107*a* and 107*b* also have respective right edges 108*a*, 108*b* and left edges 109*a* and 109*b*. As will be discussed in greater detail below, a mechanism for translation of the safety wall assembly may be provided to move the safety wall from a position aligned with the right edges 104*a*, 104*b* of the first and second platforms 102 and 103 to a position aligned with the left edges 105*a* and 105*b* of the first and second platform 102 and 103. The first and second platforms 102 and 103 may be fabricated from any suitable material, for example and without limiting the forgoing, the first and second platforms 102 and 103 may be fabricated from steel tube and steel sheet of appropriate thicknesses.

In the embodiment shown in FIGS. 1*a*-*c* a single safety wall 110 is provided. The safety wall 110 is comprised of a first wall section 111, having a platform facing end 112 and an opposing engagement end 113, a left side surface 114 and a right side surface 115 and recesses 116*a*, 116*b* in the left side 114 and right side 115 surfaces adjacent to the platform facing end 112 of the first wall section 111. The safety wall 110 further comprises a second wall section 117 having a platform facing end 118 and an opposing engagement end 119, a left side surface 120 and a right side surface 121 and recesses 122*a*, 122*b* in the left side 120 and right side 121 surfaces adjacent to the platform facing end 118 of the second wall section 117.

The first wall section 111 and the second wall section 117 are telescopically engaged with each other at their respective engagement ends, 113 and 119. The telescopic engagement of the first and second wall sections 111 and 117 allows the safety wall 110 to expand and retract in length along the longitudinal axis of the mobile barrier. The mechanism of this telescopic expansion and contraction could take one of several forms. In its most basic form, a set of brakes may be activated on the wheels coupled to the second platform 103, and then the tractor 101 may operate in either a forward or reverse direction, thereby pulling the first and second wall sections 111 and 117 further out of telescopic engagement, i.e. expanding the length of safety wall 110, if the tractor 101 is operated in the forward direction, or pushing the first and second wall sections 111 and 117 into further into telescopic engagement, i.e. retracting the length of the safety wall 110, if the tractor 101 is operated in the reverse direction. Other mechanisms to expand and retract the length of the safety wall 110 may be provided. For example, a hydraulic cylinder disposed within the telescopically engaged first and second wall sections 111 and 117 may be activated to expand or retract, thereby expanding or retracting the length of the safety wall 110. Further, a mechanical linkage, such as a rack and pinion or similar arrangement may be disposed within the telescopically engaged first and second wall sections 111 and 117 to accomplish expanding or retracting the length of the safety wall 110. One of ordinary skill in the art will readily appreciate that any mechanism known in the art to accomplish expanding or retracting the length of the safety wall 110 falls within the scope of this disclosure.

FIGS. 1*a-c* demonstrate the movement of the safety wall 110 from one side of the mobile barrier to the other side. As can be seen in FIGS. 1*a-c*, several variable length braces are employed in this movement process and provide structural stability to the safety wall 110 when it is in various positions of translation. Thus, in FIGS. 1*a-c*, the mobile barrier 100 may be provided with a first variable length brace 123 connected along the right edge 108*a* of the interior surface 107*a* of the first platform 102 and extending to a first connection point 124 on the right side surface 115 of the first wall section 111. Similarly, a second variable length brace 125 may be provided, connected along the left edge 109*a* of the interior surface 107*a* of the first platform 102 and extending to a second connection point 126 on the left side surface 114 of the first wall section 111.

As can further be seen in FIGS. 1*a-c*, similar variable length braces may also be provided on the second wall section 117. Thus, a third variable length brace 127 may be provided, connected along the right edge 108*b* of the interior surface 107*b* of the second platform 103 and extending to a third connection point 128 on the right side surface 121 of the second wall section 117. A fourth variable length brace 129 may be provided, connected along the left edge 109*b* of the interior surface 107*b* of the second platform 103 and extending to a fourth connection point 130 on the left side surface 120 of the second wall section 117.

As can be seen in the translation of the safety wall 110 shown in FIGS. 1*a-c*, each of the first, second, third and fourth variable length braces (123, 125, 127, and 129) expand and retract as the safety wall assembly 110 moves from the position aligned with the right edges 104*a, b* of the first and second platforms 102 and 103 to the position aligned with the left edges 105 *a, b* of the first and second platforms 102 and 103. Further, when the safety wall assembly 110 is in the position aligned with the right edges 104*a, b* of the first and second platforms 102 and 103, the first and third variable length braces 123 and 127 are received within the recesses 116*b* and 122*b* on the right side surfaces 115 and 121 of the first and second wall sections 111 and 117. In this position, the safety wall assembly 110 has a substantially planar surface extending from the first platform 102 to the second platform 103 along the right sides thereof, and the second and fourth variable length braces 125 and 129 are in a fully extended position. This position in shown in FIG. 1*a*. It should be appreciated that when the safety wall assembly 110 is in the position shown in FIG. 1*a*, an area protected from vehicular incursion 131 is formed by the first and second platforms 102 and 103 and the safety wall assembly 110. Workers may perform roadwork or other tasks in the area protected from vehicular incursion 131.

Similarly, FIG. 1*c* shows the safety wall in a position aligned with the left edge of the first and second platforms 102 and 103. When the safety wall assembly 110 is in the position aligned with the left edges 109*a, b* of the first and second platforms 102 and 103, the second and fourth variable length braces 125 and 129 are received within the recesses 116*a* and 122*a* on the left side surfaces 114 and 120 of the first and second wall sections 111 and 117. In this position, the safety wall assembly 110 has a planar surface extending from the first platform 102 to the second platform 103 along the left sides thereof, and the first and third variable length braces 123 and 127 are in a fully extended position. It should be appreciated that when the safety wall assembly 110 is in the position shown in the FIG. 1*c*, an area protected from vehicular incursion 132 is formed by the first and second platforms 102 and 103 and the safety wall 110. Workers may perform roadwork or other tasks in the area protected from vehicular incursion 132.

FIG. 1*b* shows an intermediate position for the safety wall 110. In this intermediate position, the safety wall 110 is aligned with neither the right side nor the left side of the platforms 102 and 103. Similarly, in this intermediate position all of the first, second, third and fourth variable length braces (123, 125, 127, and 129) are in a partially-extended position, and none of the variable length braces are received in the recesses located on the safety wall assembly 110. The intermediate position shown in FIG. 1*b* demonstrates the position of the various components during translation of the safety wall 110 from one side of the mobile barrier to the opposite side, however, this position would not be used during actual use of the mobile barrier.

FIGS. 2*a*-2*c* and 3*a-b* show a second embodiment of the mobile barrier with a sliding reinforced wall in two modes of operation. It should be appreciated that the second embodiment of the mobile barrier shown in FIGS. 2*a-c* and 3*a-b* is very similar to the first embodiment shown in FIGS. 1*a-c*, with the difference being that the second embodiment has two independently translatable safety walls, while the first embodiment has only one. Thus, there are many elements which are common to both the first and second embodiments and these common elements will be identified by the same numerals as used in the description of FIGS. 1*a-c*.

Figure 2A:
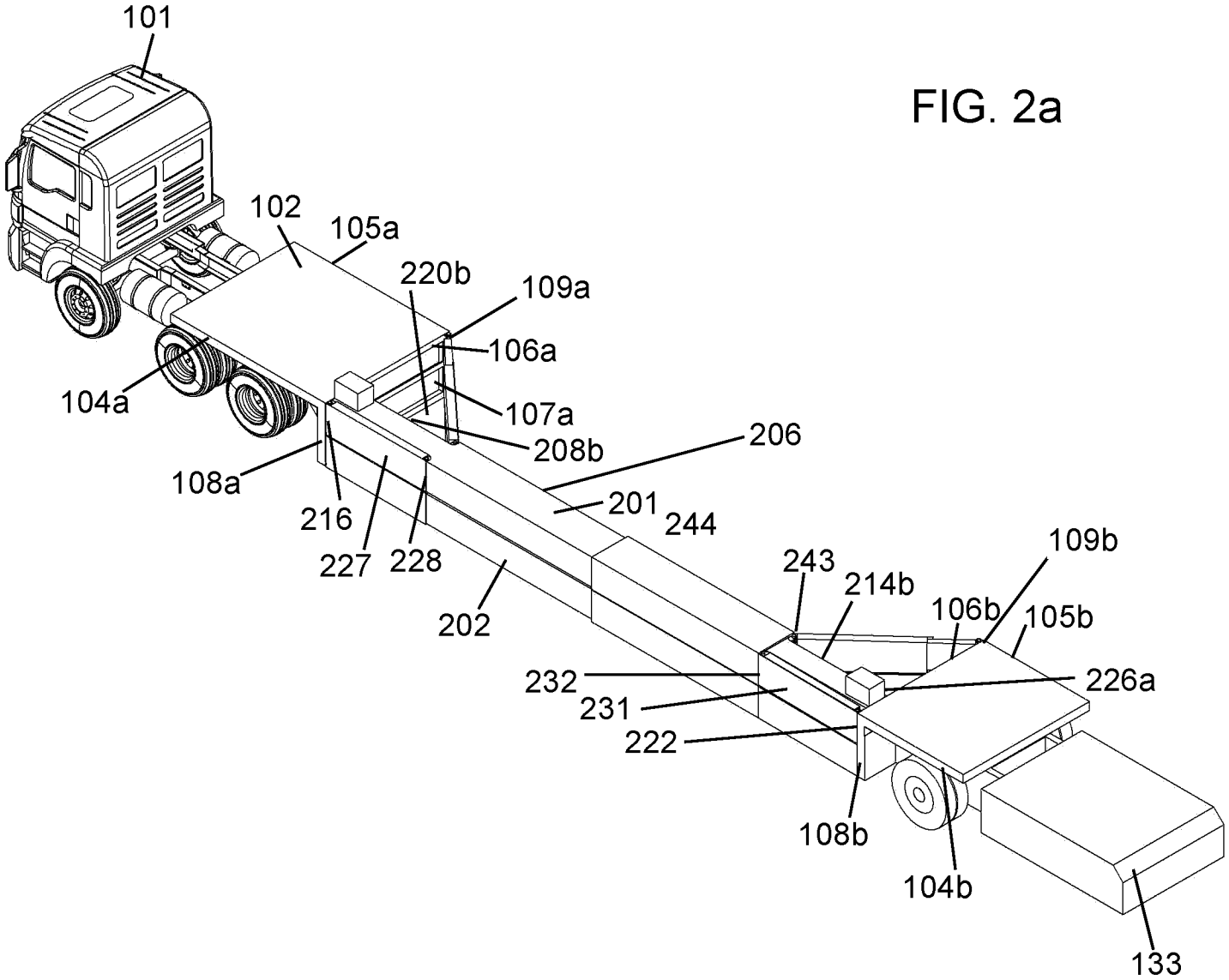
FIGS. 2*a*-2*c* shown a second embodiment of the mobile barrier with a sliding reinforced wall in a first mode of operation.
Figure 2B:
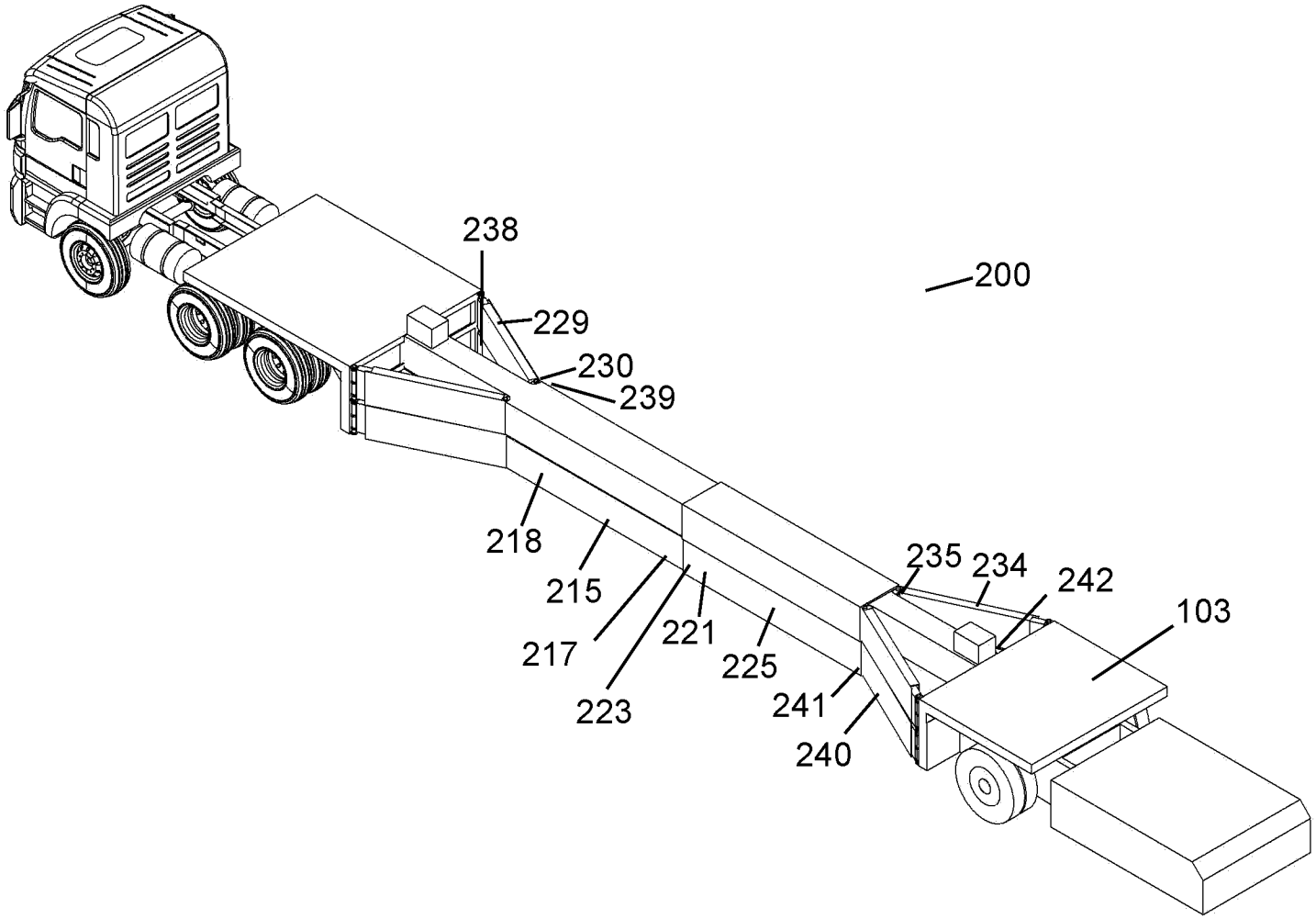
Figure 2C:
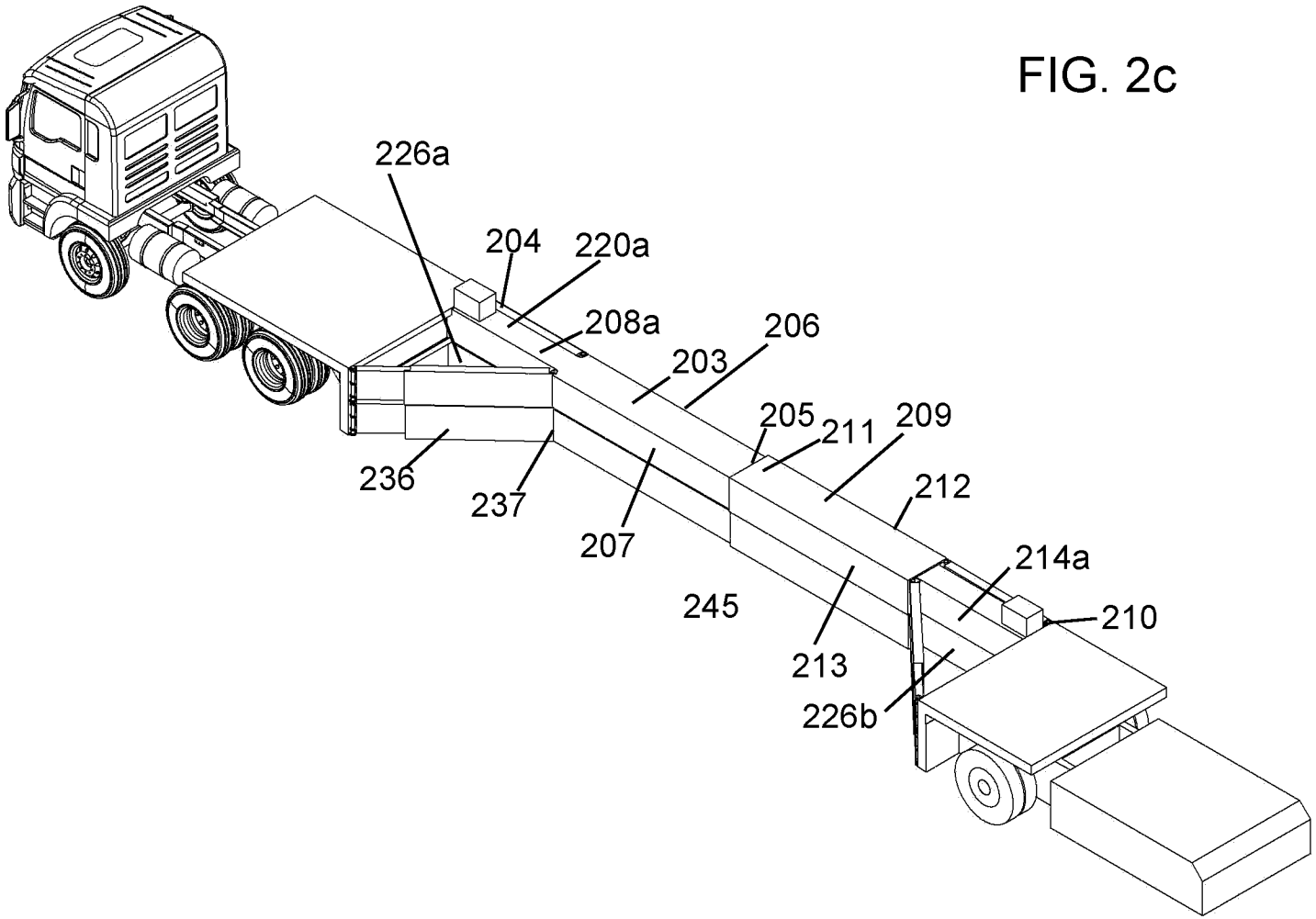

In FIGS. 2*a-c* and 3*a-b*, the mobile barrier 200 may be connected to a tractor 101 for transport to a job site. As discussed above, in FIGS. 2*a-c* and 3*a-b* a heavy duty commercial vehicle of FHWA class 8 is shown, it should be appreciated that any vehicle capable of towing the mobile barrier could be used in place of the tractor 101. If a heavy duty commercial vehicle, such as the one shown in FIGS. 2*a-c*, is used to tow the mobile barrier 100, the barrier may be provided with a kingpin (not shown) that mates with a fifth wheel (not shown) on the tractor 101 to couple the mobile barrier 200 to the tractor 101 for towing. Alternatively, if the mobile barrier is to be towed by another type of vehicle, e.g. a dump truck, that does not have a fifth wheel capable of engaging a kingpin, an alternative hitch may be provided on the mobile barrier 200 to couple to such a vehicle. It should further be appreciated that the mobile barrier 200 may be provided with more than one type of hitch, so that it could be towed by multiple types of vehicles. By way of example and without limitation, the mobile barrier 200 could be provided with a kingpin to couple to FHWA class 8 tractors as well as another hitch to couple to suitable vehicles that do not use a kingpin for coupling. Any and all hitches that perform the function of coupling the mobile barrier 200 to a vehicle capable of towing it are included within the scope of this disclosure.

Also shown in FIGS. 2*a-c* and 3*a-b*, are the first and second platforms 102 and 103. As shown in FIGS. 2*a-c* and 3*a-b*, the first platform 102 may have a kingpin (not shown) that allows the first platform 102 to couple to a towing vehicle, such as the tractor 101. In this case, the first platform 102 need not be provided with an axle and a set of wheels, because the wheels on the towing vehicle are disposed underneath the first platform 102. As shown in FIGS. 2*a-c* and 3*a-b*, the second platform 103 is provided with an axle and a set of wheels. It should be appreciated that several variations on the construction of the first and second platforms 102 and 103 are within the scope of this disclosure. By way of example and without limitation, both first and second platforms 102 and 103 may each be provided with one or more sets of axles and wheels. Alternatively, neither of the first and second platforms 102 and 103 may be provided with axles and wheels, in which case, the first platform 102 will overlie the wheels on a towing vehicle, and a separate wheeled caboose (not shown) may be provided at the second platform 103 to provide wheels for the second platform 103. A Truck Mounted Attenuator (TMA) 133 may be provided on the second platform 103 to absorb the kinetic energy of a rear-end impact on the mobile barrier.

As can be seen in FIGS. 2*a-c* and 3*a-b*, the first and second platforms 102 and 103 each have a right edge 104*a*, 104*b* and a left edge 105*a*, 105*b*; an interior edge 106*a*, 106*b* perpendicular to the respective right and left edges and an interior surface 107*a*, 107*b* depending downwardly from the interior edge. The interior surfaces 107*a* and 107*b* also have respective right edges 108*a*, 108*b* and left edges 109*a* and 109*b*. The first and second platforms 102 and 103 may be fabricated from any suitable material, for example and without limiting the forgoing, the first and second platforms 102 and 103 may be fabricated from steel tube and steel sheet of appropriate thicknesses.

In the second embodiment of the mobile barrier shown in FIGS. 2*a-c* and 3*a-b*, two safety wall assemblies are provided. Thus, in FIGS. 2*a-c* and 3*a-b*, top and bottom safety wall assemblies, 201 and 202, respectively, may be provided. Each of the top and bottom safety wall assemblies 201 and 202 may have a mechanism for translation of the respective safety wall assembly from a position aligned with the right edges 104 *a, b* of the first and second platforms 102 and 103 to a position aligned with the left edges 105*a, b* of the first and second platforms 102 and 103.

The top safety wall 201 is comprised of a first top wall section 203, having a platform facing end 204 and an opposing engagement end 205, a left side surface 206 and a right side surface 207 and recesses 208*a*, 208*b* in the left side 206 and right side 207 surfaces adjacent to the platform facing end 204 of the first top wall section 203. The top safety wall 201 further comprises a second top wall section 209 having a platform facing end 210 and an opposing engagement end 211, a left side surface 212 and a right side surface 213 and recesses 214*a*, 214*b* in the right side 213 and left side 212 surfaces adjacent to the platform facing end 210 of the second top wall section 209.

Similarly, the bottom safety wall 202, shown in FIGS. 2*a-c*, is comprised of a first bottom wall section 215, having a platform facing end 216 and an opposing engagement end 217, a right side surface 218 and a left side surface 219 and recesses 220*a*, 220*b* in the right side 218 and left side 219 surfaces adjacent to the platform facing end 216 of the first bottom wall section 215. The bottom safety wall 202 further comprises a second bottom wall section 221 having a platform facing end 222 and an opposing engagement end 223, a left side surface 224 and a right side surface 225 and recesses 226*a*, 226*b* in the left side 224 and right side 225 surfaces adjacent to the platform facing end 222 of the second bottom wall section 215.

It should be appreciated that the first top wall section 203 and the second top wall section 209 are telescopically engaged with each other at their respective engagement ends, 205 and 211, and likewise, the first bottom wall section 215 and the second bottom wall section 221 are also telescopically engaged with each other at their respective engagement ends, 217 and 223. The telescopic engagement of the first and second top wall sections 203 and 209, and first and second bottom wall sections, 215 and 221 allows each of the top and bottom the safety walls 201 and 202 to expand and retract in length along the longitudinal axis of the mobile barrier. The mechanism of this telescopic expansion and contraction could take one of several forms. In its most basic form, a set of brakes may be activated on the wheels coupled to the second platform 103, and then the tractor 101 may operate in either a forward or reverse directions, thereby pulling the first and second top and bottom wall sections 203, 215 and 209, 221 further out of telescopic engagement, i.e. expanding the length of top and bottom safety walls 201 and 202, if the tractor 101 is operated in the forward direction, or pushing the first and second top and bottom wall sections 203, 215 and 209, 221 into further into telescopic engagement, i.e. retracting the length of the safety walls 201 and 202, if the tractor 101 is operated in the reverse direction.

Other mechanisms to expand and retract the length of the top and bottom safety walls 201 and 202 may be provided. For example, a hydraulic cylinder disposed within the telescopically engaged wall sections may be activated to expand or retract, thereby expanding or retracting the length of the safety walls. Further, a mechanical linkage, such as a rack and pinion or similar arrangement may be disposed within the telescopically engaged wall sections to accomplish expanding or retracting the length of the safety walls. One of ordinary skill in the art will readily appreciate that any mechanism known in the art to accomplish expanding or retracting the length of the safety walls falls within the scope of this disclosure. Further, it should be appreciated that both the top and bottom safety wall assemblies 201 and 202 may be provided with the same mechanism of expanding and retracting, or different mechanisms could be used in the top and bottom safety wall assemblies, depending on the requirements of any particular design.

FIGS. 2*a-c* and 3*a-b* demonstrate the movement of the top and bottom safety walls 201 and 202 from one side of the mobile barrier to the other side. As can be seen in FIGS. 2*a-c* and 3*a-b*, several variable length braces are employed in this movement process and provide structural stability to the top and bottom safety walls 201 and 202 when they are in various positions of translation. Thus, in FIGS. 2*a-c* and 3*a-b*, the mobile barrier 200 may be provided with a first variable length brace 227 connected along the right edge 108*a* of the interior surface 107*a* of the first platform 102 and extending to a first connection point 228 on the right side surface 207 of the first top wall section 203. Similarly, a second variable length brace 229 may be provided, connected along the left edge 109*a* of the interior surface 107*a* of the first platform 102 and extending to a second connection point 230 on the left side surface 206 of the first top wall section 203.

As can further be seen in FIGS. 2*a-c* and 3*a-b*, similar variable length braces may also be provided on the second top wall section 209. Thus, a third variable length brace 231 may be provided, connected along the right edge 108*b* of the interior surface 107*b* of the second platform 103 and extending to a third connection point 232 on the right side surface 213 of the second top wall section 209. A fourth variable length brace 234 may be provided, connected along the left edge 109*b* of the interior surface 107*b* of the second platform 103 and extending to a fourth connection point 235 on the left side surface 212 of the second top wall section 209.

As can further be seen in FIGS. 2*a-c* and 3*a-b*, the mobile barrier 200 may be provided with a fifth variable length brace 236 connected along the right edge 108*a* of the interior surface 107*a* of the first platform 102 and extending to a fifth connection point 237 on the right side surface 218 of the first bottom wall section 215. Similarly, a sixth variable length brace 238 may be provided, connected along the left edge 109*a* of the interior surface 107*a* of the first platform 102 and extending to a sixth connection point 239 on the left side surface 218 of the first bottom wall section 215.

As can further be seen in FIGS. 2*a-c* and 3*a-b*, similar variable length braces may also be provided on the second bottom wall section 221. Thus, a seventh variable length brace 240 may be provided, connected along the right edge 108*b* of the interior surface 107*b* of the second platform 103 and extending to a seventh connection point 241 on the right side surface 225 of the second wall section 221. A eighth variable length brace 242 may be provided, connected along the left edge 109*b* of the interior surface 107*b* of the second platform 103 and extending to an eighth connection point 243 on the left side surface 224 of the second wall section 221.

As can be seen in the translation of the top and bottom safety walls 201 and 202 shown in FIGS. 2*a-c*, each of the first, second, third, fourth, fifth, sixth, seventh and eighth variable length braces (227, 229, 231, 234, 236, 238, 240 and 242) expand and retract as the top and bottom safety wall assembles 201 and 202 move from the position aligned with the right edges 104*a, b* of the first and second platforms 102 and 103 to the position aligned with the left edges 105 *a, b* of the first and second platforms 102 and 103. Further, when the top and bottom safety wall assemblies 201 and 202 are in the position aligned with the right edges 104*a, b* of the first and second platforms 102 and 103, the first, third, fifth and seventh variable length braces 227, 231, 236 and 240 are received within the recesses 208*b*, 214*b*, 220*b* and 226*b* respectively, all on the right side surfaces 207, 213, 219 and 225 of the first and second top and bottom wall sections 203, 209, 215 and 221. In this position, the top and bottom safety wall assemblies 201 and 202 have a substantially planar surface extending from the first platform 102 to the second platform 103 along the right sides thereof, and the second, fourth, sixth and eighth variable length braces 229, 234, 238 and 242 are in a fully extended position. This position in shown in FIG. 2*a*. It should be appreciated that when the top and bottom safety wall assemblies 201 and 202 are in the position shown in FIG. 1*a*, an area protected from vehicular incursion 244 is formed by the first and second platforms 102 and 103 and the top and bottom safety wall assemblies 201 and 202. Workers may perform roadwork or other tasks in the area protected from vehicular incursion 244.

Similarly, FIG. 2*c* shows the safety wall in a position aligned with the left edge of the first and second platforms 102 and 103. When the top and bottom safety wall assemblies 201 and 202 are in the position aligned with the left edges 109*a, b* of the first and second platforms 102 and 103, the second, fourth, sixth and eighth variable length braces 229, 234, 238 and 242 are received within the recesses 208*a*, 214*a*, 220*a* and 226*a*, respectively, on the left side surfaces 206, 212, 218 and 224 of the first and second top and bottom wall sections 203, 209, 215 and 221. In this position, the top and bottom safety wall assemblies 201 and 202 have a planar surface extending from the first platform 102 to the second platform 103 along the left sides thereof, and the first, third, fifth and seventh variable length braces 227, 231, 236 and 240 are in a fully extended position. It should be appreciated that when the top and bottom safety wall assemblies 201 and 202 are in the position shown in the FIG. 1*c*, an area protected from vehicular incursion 245 is formed by the first and second platforms 102 and 103 and the top and bottom safety walls 201 and 202. Workers may perform roadwork or other tasks in the area protected from vehicular incursion 245.

FIG. 2*b* shows an intermediate position for the top and bottom safety walls 201 and 202. In this intermediate position, the top and bottom safety walls 201 and 202 are aligned with neither the right side nor the left side of the platforms 102 and 103. Similarly, in this intermediate position all of the first, second, third, fourth, fifth, sixth, seventh and eighth variable length braces (227, 229, 231, 234, 236, 238, 240, 242) are in a partially-extended position, and none of the variable length braces are received in the recesses located on the top and bottom safety wall assemblies 201 and 202. The intermediate position shown in FIG. 1*b* demonstrates the position of the various components during translation of the top and bottom safety walls 201 and 202 from one side of the mobile barrier to the opposite side, however, this position would not be used during actual use of the mobile barrier.

Figure 3A:
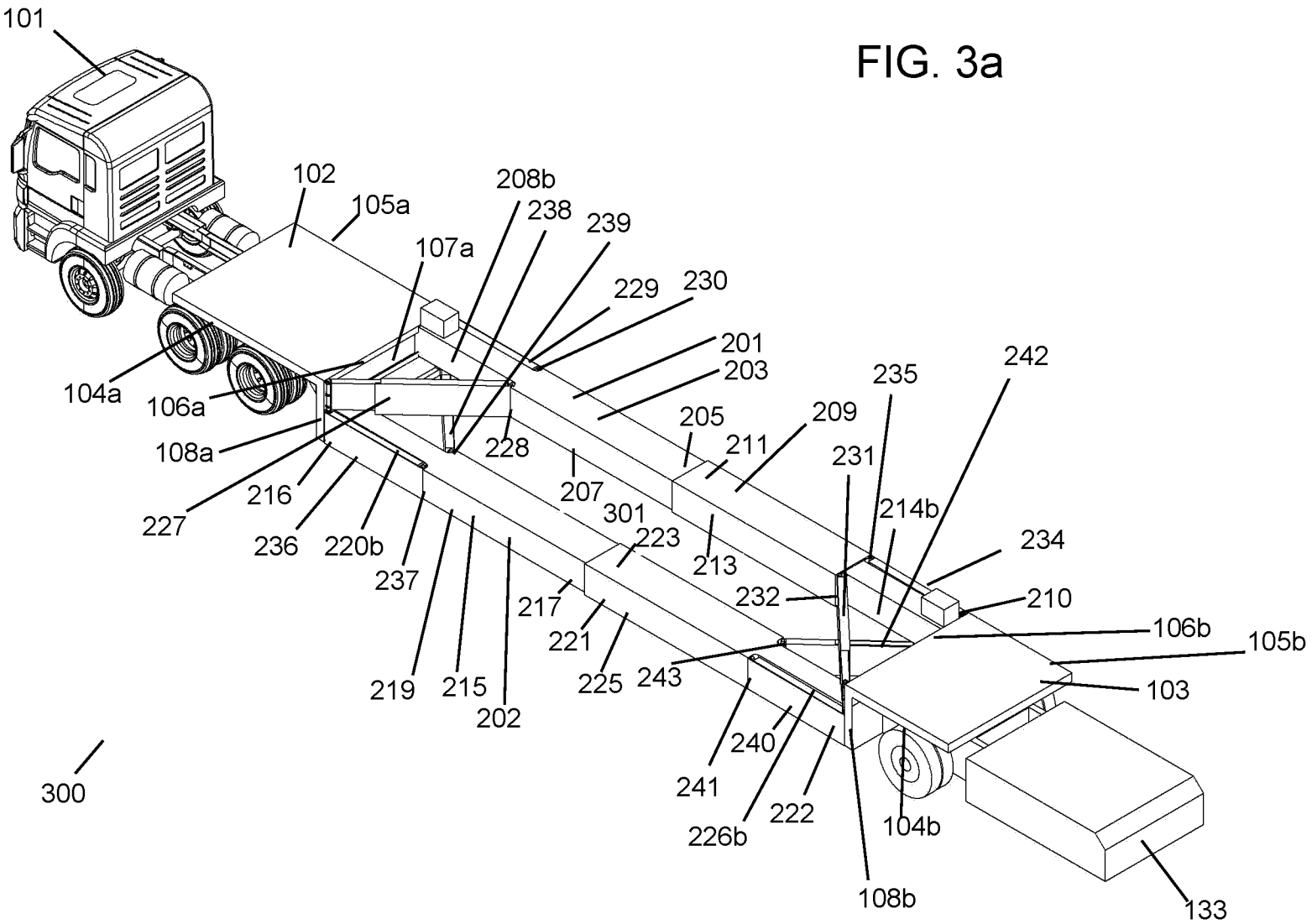
FIGS. 3*a*-3*b* show a second embodiment of the mobile barrier with a sliding reinforced wall in a second mode of operation.
Figure 3B:
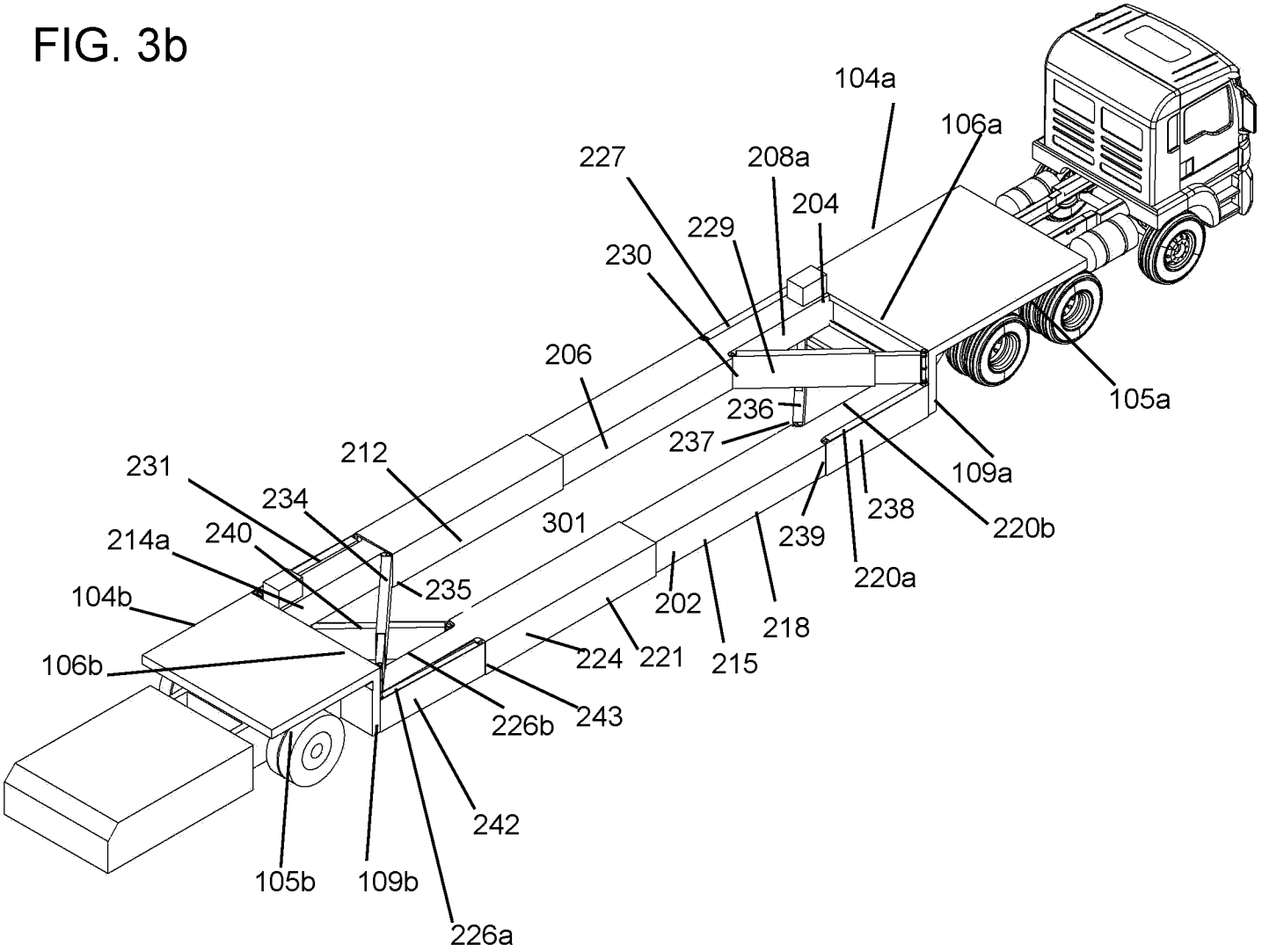

FIGS. 3*a*-3*b* show the second embodiment of the mobile barrier with a sliding reinforced wall in a second mode of operation. The mobile barrier shown in FIGS. 3*a*-3*b* is the same in all respects as the mobile barrier shown in FIGS. 2*a-c*, with the exception that the independently translatable top and bottom safety walls 201 and 202 are disposed on opposite sides of the barrier, instead of having them both on the same side of the barrier as shown in FIGS. 2*a-c*. Like numerals will be used to identify elements already identified in FIGS. 1*a-c* and 2*a-c*. Thus, the mobile barrier 300 may be connected to a tractor 101 for transport to a job site. All of the prior disclosure relative to the tractor 101 that was made with respect to FIGS. 1*a-c* and 2*a-c* are equally applicable to the barrier show in FIGS. 3*a-b*. Similarly, the barrier shown in FIGS. 3*a-b* may have first and second platforms 102 and 103 and a Truck Mounted Attenuator (TMA) 133 as discussed with respect to the previous figures.

The first and second platforms 102 and 103 each have a right edge 104*a*, 104*b* and a left edge 105*a*, 105*b*; an interior edge 106*a*, 106*b* perpendicular to the respective right and left edges and an interior surface 107*a*, 107*b* depending downwardly from the interior edge. The interior surfaces 107*a* and 107*b* also have respective right edges 108*a*, 108*b* and left edges 109*a* and 109*b*.

Top and bottom safety wall assemblies, 201 and 202, respectively, may be provided. Each of the top and bottom safety wall assemblies 201 and 202 may have a mechanism for translation of the respective safety wall assembly from a position aligned with the right edges 104*a, b* of the first and second platforms 102 and 103 to a position aligned with the left edges 105*a, b* of the first and second platforms 102 and 103.

The top safety wall 201 is comprised of a first top wall section 203, having a platform facing end 204 and an opposing engagement end 205, a left side surface 206 and a right side surface 207 and recesses 208*a*, 208*b* in the left side 206 and right side 207 surfaces adjacent to the platform facing end 204 of the first top wall section 203. The top safety wall 201 further comprises a second top wall section 209 having a platform facing end 210 and an opposing engagement end 211, a left side surface 212 and a right side surface 213 and recesses 214*a*, 214*b* in the left side 212 and right side 213 surfaces adjacent to the platform facing end 210 of the second top wall section 209.

Similarly, the bottom safety wall 202 is comprised of a first bottom wall section 215, having a platform facing end 216 and an opposing engagement end 217, a left side surface 218 and a right side surface 219 and recesses 220*a*, 220*b* in the left side 218 and right side 219 surfaces adjacent to the platform facing end 216 of the first bottom wall section 215. The bottom safety wall 202 further comprises a second bottom wall section 221 having a platform facing end 222 and an opposing engagement end 223, a left side surface 224 and a right side surface 225 and recesses 226*a*, 226*b* in the left side 224 and right side 225 surfaces adjacent to the platform facing end 222 of the second bottom wall section 215.

The first top wall section 203 and the second top wall section 209 are telescopically engaged with each other at their respective engagement ends, 205 and 211, and likewise, the first bottom wall section 215 and the second bottom wall section 221 are also telescopically engaged with each other at their respective engagement ends, 217 and 223. This telescopic engagement is the same as described with respect to the prior figures.

The mobile barrier 300 may be provided with a first variable length brace 227 connected along the right edge 108*a* of the interior surface 107*a* of the first platform 102 and extending to a first connection point 228 on the right side surface 207 of the first top wall section 203. Similarly, a second variable length brace 229 may be provided, connected along the left edge 109*a* of the interior surface 107*a* of the first platform 102 and extending to a second connection point 230 on the left side surface 206 of the first top wall section 203.

As can further be seen in FIGS. 3*a-b*, similar variable length braces may also be provided on the second top wall section 209. Thus, a third variable length brace 231 may be provided, connected along the right edge 108*b* of the interior surface 107*b* of the second platform 103 and extending to a third connection point 232 on the right side surface 213 of the second top wall section 209. A fourth variable length brace 234 may be provided, connected along the left edge 109*b* of the interior surface 107*b* of the second platform 103 and extending to a fourth connection point 235 on the left side surface 212 of the second top wall section 209.

The mobile barrier 200 may be provided with a fifth variable length brace 236 connected along the right edge 108*a* of the interior surface 107*a* of the first platform 102 and extending to a fifth connection point 237 on the right side surface 219 of the first bottom wall section 215. Similarly, a sixth variable length brace 238 may be provided, connected along the left edge 109*a* of the interior surface 107*a* of the first platform 102 and extending to a sixth connection point 239 on the left side surface 218 of the first bottom wall section 215.

Similar variable length braces may also be provided on the second bottom wall section 221. Thus, a seventh variable length brace 240 may be provided, connected along the right edge 108*b* of the interior surface 107*b* of the second platform 103 and extending to a seventh connection point 241 on the right side surface 225 of the second wall section 221. A eighth variable length brace 242 may be provided, connected along the left edge 109*b* of the interior surface 107*b* of the second platform 103 and extending to an eighth connection point 243 on the left side surface 224 of the second wall section 221.

In FIG. 3*a* the barrier 300 is shown having the top safety wall 201 disposed on the left side of the barrier and the bottom safety wall 202 disposed on the right side of the barrier. When, as in FIG. 3*a*, the top safety wall assembly 201 is in the position aligned with the left edges 105*a, b* of the first and second platforms 102 and 103, the second and fourth variable length braces 229 and 234 are received within the recesses 208*a* and 214*a*, respectively, on the left side surfaces 206, 212 of the first and second top wall sections 203 and 209. In this position, the top safety wall 201 has a planar surface extending from the first platform 102 to the second platform 103 along the left sides thereof, and the first and third variable length braces 227 and 231 are in a fully extended position. When, as in FIG. 3*a*, the bottom safety wall assembly 202 is in the position aligned with the right edges 104*a, b* of the first and second platforms 102 and 103, the fifth and seventh variable length braces 236 and 240 are received within the recesses 220*b* and 226*b* respectively, all on the right side surfaces 219 and 225 of the first and second bottom wall sections 215 and 221. In this position, the bottom safety wall 202 has a substantially planar surface extending from the first platform 102 to the second platform 103 along the right sides thereof, and the sixth and eighth variable length braces 238 and 242 are in a fully extended position.

In FIG. 3*b* the barrier 300 is shown having the top safety wall 201 disposed on the right side of the barrier and the bottom safety wall 202 disposed on the left side of the barrier. When, as in FIG. 3*b*, the top safety wall 201 is in the position aligned with the right edges 104*a, b* of the first and second platforms 102 and 103, the first and third variable length braces 227 and 231 are received within the recesses 208*b* and 214*b* respectively, on the right side surfaces 207, 213 of the first and second top wall sections 203 and 209. In this position, the top safety wall 201 has a substantially planar surface extending from the first platform 102 to the second platform 103 along the right sides thereof, and the second and fourth variable length braces 229 and 234 are in a fully extended position. When, as in FIG. 3*b*, the bottom safety wall 202 is in the position aligned with the left edges 105*a, b* of the first and second platforms 102 and 103, the sixth and eighth variable length braces 238 and 242 are received within the recesses 220*a* and 226*a*, respectively, on the left side surfaces 218 and 224 of the first and second bottom wall sections 215 and 221. In this position, the bottom safety wall 202 has a planar surface extending from the first platform 102 to the second platform 103 along the left sides thereof, and the fifth and seventh variable length braces 236 and 240 are in a fully extended position.

It should be appreciated that in both arrangements shown in FIGS. 3*a-b*, an area protected from vehicular incursion 301 is formed by the first and second platforms 102 and 103 and the top and bottom safety wall assemblies 201 and 202. Workers may perform roadwork or other tasks in the area protected from vehicular incursion 301. Note that the area protected from vehicular incursion 301 differs from those shown in FIGS. 2*a-c*, in that the area protected from vehicular incursion 301 is protected from incursions on both the left and right sides of the mobile barrier, while those shown in FIGS. 2*a-c* are protected from incursion only on one side of the barrier, either left or right.

As discussed above, all of the embodiments shown require a mechanism for translation of the safety wall assembly from a position aligned with the right edge of the first and second platforms to a position aligned with the left edge of the first and second platforms. If more than one safety wall is provided as shown in the embodiment of FIGS. 2*a-c* and 3*a-b*, then a mechanism for translation must be provided for each of the safety wall assemblies. Examples of such mechanisms are disclosed below. One of ordinary skill in the art will readily appreciate that these examples are not limiting and that any mechanism known in the art capable of translating the size and weight of a safety wall assembly from one side of the platforms to the other could be used. Moreover, in an embodiment with more than one safety wall assembly the same type of mechanism could be used for each safety wall assembly or differing types of mechanisms could be used for the various safety wall assemblies, depending on the requirements of any specific implementation.

One embodiment of the mechanism for translation of the safety wall assembly from a position aligned with the right edge of the first and second platforms may be two motor-driven rack and pinion assemblies located at each end of the safety wall assembly. In this embodiment, a rack may be mounted to each of the interior surfaces of the first and second platforms, and motor driven pinions may be provided on each end of the safety wall assembly. Another embodiment of the mechanism for translation of the safety wall assembly from a position aligned with the right edge of the first and second platforms may be two motor-driven rollers riding in channels located at each end of the safety wall assembly. In this embodiment, a channel may be mounted to each of the interior surfaces of the first and second platforms, and motor driven rollers may be provided on each end of the safety wall assembly.

Various aspects of the variable length braces are also common to all embodiments of the mobile barrier. The following disclosure applies to all of the variable length braces, regardless of whether the embodiment has four braces as shown in FIGS. 1*a-c* or eight as shown in FIGS. 2*a-c* and 3*a-b*. For instance, it is advantageous to be able to lock the variable length braces in a desired position. If the braces are in a fully extended or fully retracted position, such as those shown in FIGS. 1*a*, 1*c*, 2*a*, 2*c*, 3*a* and 3*b*, it is advantageous to lock the braces in their respective positions while work is carried out in the area protected from vehicular incursion or while the mobile barrier is being transported. Similarly, if the variable length braces are in the half-way extended position such as is shown in FIGS. 1*b* and 2*b*, it is advantageous to lock the braces in those positions as well.

In one embodiment, the variable length braces may be provided with a detent mechanism that actuates at the fully retracted position, the half-way extended position and the fully extended position, and the actuation of the detent mechanism prevents the respective variable length braces from further extending or retracting. A user may disengage the detent mechanism to adjust the braces as required. In another embodiment, the variable length braces may be provided with holes in the braces at the fully retracted position, the half-way extended position and the fully extended position and a corresponding pin may pass through the holes in the respective variable length braces, preventing further extension or retraction. A user would remove the pin to adjust the braces as required. It should be appreciated that one or both of these embodiments may be used on the variable length braces, e.g. a detent mechanism could be employed with a pin and hole arrangement used for extra holding power. Moreover, one or both of these embodiments could be used on different braces on the same barrier, e.g. braces on a top safety wall may be provided with detent mechanisms, while braces on the lower safety wall are provided with the pin and hole arrangement. One of ordinary skill in the art will also readily appreciate that any mechanism known in the art to lock the variable length braces into a desired position may be used in the mobile barrier, as long as the mechanism is capable of withstanding the loads associated with this application.

In yet another embodiment, the safety wall assembly may be translated by mechanisms located in the variable length braces. In this embodiment, the mechanism for translation of the safety wall assembly from a position aligned with the right edge of the first and second platforms to a position aligned with the left edge of the first and second platforms may be hydraulic cylinders disposed in each of the variable length braces. Thus, in the barrier shown in FIGS. 1*a-c*, hydraulic cylinders disposed in the first, second, third and fourth variable length braces may be used to translate the safety wall from side to side. Further in the barrier shown in FIGS. 2*a-c*, hydraulic cylinders disposed in the first, second, third, fourth, fifth, sixth, seventh and eighth variable length braces may be used to translate the respective top and bottom safety walls from side to side. In this embodiment, the safety wall or walls may be provided with rollers disposed at both platform facing ends thereof, and said rollers may ride in channels located on the interior surfaces of the first and second platforms respectively. In this embodiment, when the hydraulic cylinders in the variable length braces extend and retract, the rollers on the safety wall assembly move in the channel, moving the safety wall from one side of the platforms to the other.

In this embodiment, it may be advantageous to lock the safety wall into a desired position. Similar to the embodiment of locking the variable braces disclosed above, the barrier may be provided with plurality of releasable stops to retain the safety wall assembly in a first position aligned with the right edge of the first and second platforms, a second position disposed equidistant between the right and left edges of the first and second platforms, and a third position aligned with the left edge of the first and second platforms. Additionally, the safety wall assembly may be further secured in the first, second or third positions by pins that pass through holes in the safety wall assembly and into a corresponding holes in the first and second platforms.

Further aspects of the mobile barrier are common to all embodiments. For example, the length of the mobile barrier, which is determined by the length of the safety wall sections can be varied. In some cases, a short version of the barrier may be advantageous. In the case of a short version of the barrier, a single, non-telescoping wall section may be provided of the appropriate length. Alternatively, longer versions of the barrier may also be advantageous. Any length of barrier that can withstand the forces of this application may be used. In addition to the truck mounted attenuator provided on the mobile barrier, the barrier could also be provided with lighting, signage, visual barriers or any combination of the foregoing. Brackets may be provided on either or both of the first and second platforms, for attaching various devices such as cranes, mixers, water tanks or side dump buckets. One or both of the first and second platforms may be provided with air bags attached to the wheels and axles coupled thereto, to allow for the selective raising, lowering and leveling of the platforms. Valves may be provided to hold the air suspensions settings after an air source provided by the towing vehicle has been removed. Optionally, a ballast may be provided on the first and/or second platforms to increase the overall weight of the barrier.

It will be appreciated by those of ordinary skill in the art that, while the forgoing disclosure has been set forth in connection with particular embodiments and examples, the disclosure is not intended to be necessarily so limited, and that numerous other embodiments, examples, uses, modifications and departures from the embodiments, examples and uses described herein are intended to be encompassed by the claims attached hereto. Various features of the disclosure are set forth in the following claims.

The invention claimed is:

1. A mobile barrier comprising:

first and second platforms, each of said first and second platforms having a right edge and a left edge, an interior edge perpendicular to the respective right and left edges and an interior surface depending downwardly from the interior edge, said interior surface also having respective right and left edges, at least one of the first and second platforms engaged with an axle and a set of wheels;

a safety wall assembly, said safety wall assembly having a mechanism for translation of the safety wall assembly from a position aligned with the right edge of the first and second platforms to a position aligned with the left edge of the first and second platforms;

wherein said safety wall assembly is comprised of:

a first wall section, having a platform facing end and an opposing engagement end, a left side surface and a right side surface and recesses in the left side and right side surfaces adjacent to the platform facing end of the first wall section;

a second wall section having a platform facing end and an opposing engagement end, a left side surface and a right side surface and recesses in the left side and right side surfaces adjacent to the platform facing end of the second wall section;

wherein the second wall section and the first wall section are telescopically engaged with each other at their respective engagement ends, said telescopic engagement of the first and second wall sections allowing the safety wall assembly to expand and retract in length along the longitudinal axis of the mobile barrier;

a first variable length brace connected along the right edge of the interior surface of the first platform and extending to a first connection point on the right side surface of the first wall section;

a second variable length brace connected along the left edge of the interior surface of the first platform and extending to a second connection on the left side surface of the first wall section;

a third variable length brace connected along the right edge of the interior surface of the second platform and extending to a third connection point on the right side surface of the second wall section;

a fourth variable length brace connected along the left edge of the interior surface of the second platform and extending to a fourth connection point on the left side surface of the second wall section;

wherein each of the first, second, third and fourth variable length braces expand and retract as the safety wall assembly moves from the position aligned with the right edge of the first and second platforms to the position aligned with the left edge of the first and second platforms;

wherein when the safety wall assembly is in the position aligned with the right edge of the first and second platforms, the first and third variable length braces are received within the recesses on the right side surfaces of the first and second wall sections, the safety wall assembly has a planar surface extending from the first platform to the second platform along the right sides thereof, and the second and fourth variable length braces are in a fully extended position; and wherein when the safety wall assembly is in the position aligned with the left edge of the first and second platforms, the second and fourth variable length braces are received within the recesses on the left side surfaces of the first and second wall sections, the safety wall assembly has a planar surface extending from the first platform to the second platform along the left sides thereof, and the first and third variable length braces are in a fully extended position.

2. The mobile barrier of claim 1, wherein the mechanism for translation of the safety wall assembly from a position aligned with the right edge of the first and second platforms to a position aligned with the left edge of the first and second platforms is two motor-driven rack and pinion assemblies located at each end of the safety wall assembly.

3. The mobile barrier of claim 2, wherein a rack is mounted to each of the interior surfaces of the first and second platforms, and motor driven pinions are provided on each end of the safety wall assembly.

4. The mobile barrier of claim 2, wherein the first, second, third and fourth variable length braces have a detent mechanism that actuates at a fully retracted position, a half-way extended position and a fully extended position, and wherein the actuation of the detent mechanism prevents the respective variable length braces from further extending or retracting.

5. The mobile barrier of claim 4, wherein the first, second, third and fourth variable length braces are further secured into each of the fully retracted position, the half-way extended position and the fully extended position by a pin that passes through holes in the respective variable length braces, said pin preventing further extension or retraction.

6. The mobile barrier of claim 1, wherein the mechanism for translation of the safety wall assembly from a position aligned with the right edge of the first and second platforms to a position aligned with the left edge of the first and second platforms is two motor-driven rollers riding in channels located at each end of the safety wall assembly.

7. The mobile barrier of claim 6, wherein a channel is mounted to each of the interior surfaces of the first and second platforms, and motor driven rollers are provided on each end of the safety wall assembly.

8. The mobile barrier of claim 6, wherein the first, second, third and fourth variable length braces have a detent mechanism that actuates at a fully retracted position, a half-way extended position and a fully extended position, and wherein the actuation of the detent mechanism prevents the respective variable length braces from further extending or retracting.

9. The mobile barrier of claim 8, wherein the first, second, third and fourth variable length braces are further secured into each of the fully retracted position, the half-way extended position and the fully extended position by a pin that passes through holes in the respective variable length braces, said pin preventing further extension or retraction.

10. The mobile barrier of claim 1, wherein the mechanism for translation of the safety wall assembly from a position aligned with the right edge of the first and second platforms to a position aligned with the left edge of the first and second platforms is hydraulic cylinders disposed in each of the first, second, third and fourth variable length braces.

11. The mobile barrier of claim 10, wherein the safety wall assembly has rollers disposed at both ends thereof, and said rollers ride in channels located on the interior surfaces of the first and second platforms respectively.

12. The mobile barrier of claim 11, wherein a plurality of releasable stops retain the safety wall assembly in a first position aligned with the right edge of the first and second platforms, a second position disposed equidistant between the right and left edges of the first and second platforms, and a third position aligned with the left edge of the first and second platforms.

13. The mobile barrier of claim 12, wherein the safety wall assembly is further secured in the first, second or third positions by pins that pass through holes in the safety wall assembly and into a corresponding holes in the first and second platforms.

14. A mobile barrier comprising:

first and second platforms, each of said first and second platforms having a right edge and a left edge, an interior edge perpendicular to the respective right and left edges and an interior surface depending downwardly from the interior edge, said interior surface also having respective right and left edges, at least one of the first and second platforms engaged with an axle and a set of wheels;

top and bottom safety wall assemblies, each of said top and bottom safety wall assemblies having a mechanism for translation of the respective safety wall assembly from a position aligned with the right edge of the first and second platforms to a position aligned with the left edge of the first and second platforms;

wherein the top safety wall assembly is comprised of:

a first top wall section, having a platform facing end and an opposing engagement end, a left side surface and a right side surface and recesses in the left side and right side surfaces adjacent to the platform facing end of the first top wall section;

a second top wall section having a platform facing end and an opposing engagement end, a left side surface and a right side surface and recesses in the left side and right side surfaces adjacent to the platform facing end of the second top wall section;

wherein the first and second top wall sections are telescopically engaged with each other at their respective engagement ends, said telescopic engagement of the first and second top wall sections allowing the top safety wall assembly to expand and retract in length along the longitudinal axis of the mobile barrier;

wherein the bottom wall assembly is comprised of:

a first bottom wall section, having a platform facing end and an opposing engagement end, a left side surface and a right side surface and recesses in the left side and right side surfaces adjacent to the platform facing end of the first bottom wall section;

a second bottom wall section having a platform facing end and an opposing engagement end, a left side surface and a right side surface and recesses in the left side and right side surfaces adjacent to the platform facing end of the second bottom wall section;

wherein the first and second bottom wall sections are telescopically engaged with each other at their respective engagement ends, said telescopic engagement of the first and second bottom wall sections allowing the bottom safety wall assembly to expand and retract in length along the longitudinal axis of the mobile barrier;

a first variable length brace connected along an upper portion of the right edge of the interior surface of the first platform and extending to a first connection point on the right side surface of the first top wall section;

a second variable length brace connected along an upper portion of the left edge of the interior surface of the first platform and extending to a second connection on the left side surface of the first top wall section;

a third variable length brace connected along an upper portion of the right edge of the interior surface of the second platform and extending to a third connection point on the right side surface of the second top wall section;

a fourth variable length brace connected along an upper portion of the left edge of the interior surface of the second platform and extending to a fourth connection point on the left side surface of the second top wall section;

a fifth variable length brace connected along a lower portion of the right edge of the interior surface of the first platform and extending to a fifth connection point on the right side surface of the first bottom wall section;

a sixth variable length brace connected along a lower portion of the left edge of the interior surface of the first platform and extending to a sixth connection on the left side surface of the first bottom wall section;

a seventh variable length brace connected along a lower portion of the right edge of the interior surface of the second platform and extending to a seventh connection point on the right side surface of the second bottom wall section;

an eighth variable length brace connected along lower portion of the left edge of the interior surface of the second platform and extending to an eighth connection point on the left side surface of the second bottom wall section;

wherein each of the first, second, third, fourth, fifth, sixth, seventh and eighth variable length braces expand and retract as the respective top and bottom safety wall assemblies move from the position aligned with the right edge of the first and second platforms to the position aligned with the left edge of the first and second platforms;

wherein when the top safety wall assembly is in the position aligned with the right edge of the first and second platforms, the first and third variable length braces are received within the recesses on the right side surfaces of the first and second top wall sections, the top safety wall assembly has a planar surface extending from the first platform to the second platform along the right sides thereof, and the second and fourth variable length braces are in a fully extended position;

wherein when the top safety wall assembly is in the position aligned with the left edge of the first and second platforms, the second and fourth variable length braces are received within the recesses on the left side surfaces of the first and second top wall sections, the top safety wall assembly has a planar surface extending from the first platform to the second platform along the left sides thereof, and the first and third variable length braces are in the fully extended position;

wherein when the bottom safety wall assembly is in the position aligned with the right edge of the first and second platforms, the fifth and seventh variable length braces are received within the recesses on the right side surfaces of the first and second bottom wall sections, the bottom safety wall assembly has a planar surface extending from the first platform to the second platform along the right sides thereof, and the sixth and eighth variable length braces are in a fully extended position; and wherein when the bottom safety wall assembly is in the position aligned with the left edge of the first and second platforms, the sixth and eighth variable length braces are received within the recesses on the left side surfaces of the first and second bottom wall sections, the bottom safety wall assembly has a planar surface extending from the first platform to the second platform along the left sides thereof, and the fifth and seventh variable length braces are in the fully extended position.

15. The mobile barrier of claim 14, wherein the mechanism for translation of the top and bottom safety wall assemblies from a position aligned with the right edge of the first and second platforms to a position aligned with the left edge of the first and second platforms is two motor-driven rack and pinion assemblies located at each end of the respective safety wall assemblies.

16. The mobile barrier of claim 15, wherein two racks are mounted to each of the interior surfaces of the first and second platforms, and motor driven pinions are provided on each end of the top and bottom safety wall assemblies.

17. The mobile barrier of claim 15, wherein the first, second, third, fourth, fifth, sixth, seventh and eighth variable length braces have a detent mechanism that actuates at a fully retracted position, a half-way extended position and a fully extended position, and wherein the actuation of the detent mechanism prevents the respective variable length braces from further extending or retracting.

18. The mobile barrier of claim 17, wherein the first, second, third, fourth, fifth, sixth, seventh and eighth variable length braces are further secured into each of the fully retracted position, the half-way extended position and the fully extended position by a pin that passes through holes in the respective variable length braces, said pin preventing further extension or retraction.

19. The mobile barrier of claim 14, wherein the mechanism for translation of the top and bottom safety wall assemblies from a position aligned with the right edge of the first and second platforms to a position aligned with the left edge of the first and second platforms is motor-driven rollers riding in channels located at each end of the safety wall assembly.

20. The mobile barrier of claim 19, wherein two channels are mounted to each of the interior surfaces of the first and second platforms, and motor driven rollers are provided on each end of the top and bottom safety wall assemblies.

21. The mobile barrier of claim 19, wherein the first, second, third, fourth, fifth, sixth, seventh and eighth variable length braces have a detent mechanism that actuates at a fully retracted position, a half-way extended position and a fully extended position, and wherein the actuation of the detent mechanism prevents the respective variable length braces from further extending or retracting.

22. The mobile barrier of claim 21, wherein the first, second, third, fourth, fifth, sixth, seventh and eighth variable length braces are further secured into each of the fully retracted position, the half-way extended position and the fully extended position by a pin that passes through holes in the respective variable length braces, said pin preventing further extension or retraction.

23. The mobile barrier of claim 14, wherein the mechanism for translation of the top and bottom safety wall assemblies from a position aligned with the right edge of the first and second platforms to a position aligned with the left edge of the first and second platforms is hydraulic cylinders disposed in each of the first, second, third, fourth, fifth, sixth, seventh and eighth variable length braces.

24. The mobile barrier of claim 23, wherein the top and bottom safety wall assemblies have rollers disposed at both ends thereof, and said rollers ride in channels located on the interior surfaces of the first and second platforms respectively.

25. The mobile barrier of claim 24, wherein a plurality of releasable stops retain the top and bottom safety wall assemblies in a first position aligned with the right edge of the first and second platforms, a second position disposed equidistant between the right and left edges of the first and second platforms, and a third position aligned with the left edge of the first and second platforms.

26. The mobile barrier of claim 25, wherein the top and bottom safety wall assemblies are further secured in the first, second or third positions by pins that pass through holes in the top and bottom safety wall assemblies and into a corresponding holes in the first and second platforms.

* * * * *